US009855651B2

(12) United States Patent
Xin et al.

(10) Patent No.: US 9,855,651 B2
(45) Date of Patent: Jan. 2, 2018

(54) HAND HELD POWER TOOL WITH LOCKING ROTATABLE HANDLE

(75) Inventors: Yun Qiang Xin, Guangdong (CN); Gong Wei Zhang, Tianjin (CN)

(73) Assignee: TECHTRONIC POWER TOOLS TECHNOLOGY LIMITED, Tortola (VG)

( * ) Notice: Subject to any disclaimer, the term of this patent is extended or adjusted under 35 U.S.C. 154(b) by 756 days.

(21) Appl. No.: 14/002,993

(22) PCT Filed: Mar. 21, 2011
(Under 37 CFR 1.47)

(86) PCT No.: PCT/CN2011/072013
§ 371 (c)(1),
(2), (4) Date: Oct. 10, 2013

(87) PCT Pub. No.: WO2012/126173
PCT Pub. Date: Sep. 27, 2012

(65) Prior Publication Data
US 2014/0158391 A1 Jun. 12, 2014

(51) Int. Cl.
*B25F 5/02* (2006.01)
*B24B 23/02* (2006.01)

(52) U.S. Cl.
CPC ..... *B25F 5/02* (2013.01); *B24B 23/028* (2013.01)

(58) Field of Classification Search
CPC ..... B24B 323/028; B25F 5/02
See application file for complete search history.

(56) References Cited

U.S. PATENT DOCUMENTS 5,201,146 A * 4/1993 Fushiya ..... B23D 45/16 451/358
5,339,572 A * 8/1994 Eicher ..... B23D 45/16 451/358
5,407,381 A * 4/1995 Schaefer ..... B25F 5/02 451/344
5,466,183 A * 11/1995 Kirn ..... B23D 45/16 173/170

(Continued)

FOREIGN PATENT DOCUMENTS

| | | |
|---|---|---|
| CN | 1688418 | 10/2005 |
| DE | 102009027871 | 1/2011 |
| EP | 1327497 | 7/2003 |

OTHER PUBLICATIONS

European Patent Office Extended Search Report for Application No. 11861490.8 dated Sep. 8, 2015 (6 pages).

*Primary Examiner* — Thanh Truong
*Assistant Examiner* — Thomas Wittenschlaeger
(74) *Attorney, Agent, or Firm* — Michael Best & Friedrich LLP

(57) ABSTRACT

In an angle-grinder with a rotating handle and a latch for fixing the handle in two different rotational positions, an interlock mechanism is provided for greater security against unwanted rotation of the handle when the tool is being used. The interlock mechanism is moved to a locking position by depressing the trigger to start the motor, and thus provides a safety lock backing up the latch, in case the latch is accidentally released during use. In its unlocking position the interlock mechanism may prevent actuation of the trigger when the handle is not properly aligned in one of its operating positions.

20 Claims, 3 Drawing Sheets

(56) References Cited

U.S. PATENT DOCUMENTS

| | | | | |
|---|---|---|---|---|
| 5,681,214 | A * | 10/1997 | Kleider | B23D 45/16<br>451/344 |
| 6,293,859 | B1 * | 9/2001 | Fink | B23D 45/16<br>451/344 |
| 7,204,744 | B2 * | 4/2007 | Lamprecht | B25F 5/006<br>451/357 |
| 7,537,065 | B2 * | 5/2009 | Gallagher | B24B 23/02<br>173/170 |

* cited by examiner

HAND HELD POWER TOOL WITH LOCKING ROTATABLE HANDLE

CROSS-REFERENCE TO RELATED APPLICATIONS

This application is a national stage filing under 35 U.S.C. 371 of International Application No. PCT/CN2011/072013 filed Mar. 21, 2011, the content of which is incorporated herein by reference in its entirety.

TECHNICAL FIELD

The present invention relates to a hand-held power tool, particularly an angle grinder. In particular it relates to such a hand-held power tool which has a housing for receiving an electric motor, a tool head and a handle arranged on opposite ends of the housing, the handle being rotatable relative to the housing, and a locking device for fixing the housing and handle in at least two different positions.

BACKGROUND OF THE INVENTION

Hand-held power tools, particularly angle grinders, typically have an on/off switch for the electric motor which is actuated via a trigger. The trigger is situated at the underside of the handle and is actuated by at least one finger when grasping the handle and held in an actuated position while the machine is in use. The design of the handle and trigger is such that it can best be used in one individual working position relative to the user. However an angle grinder, for instance, is regularly rotated about 90 degrees in use between two different orientations: a first with the disc roughly horizontal (e.g. for grinding or sanding) and a second where the disc is roughly upright (e.g. for cutting). To accommodate these two operating orientations in an ergonomically satisfactory manner a rotatable handle may be provided. Such a handle may rotate generally about its longitudinal axis, relative to the housing and tool head fixed to the housing and can be fixed in defined rotational positions by a latching arrangement.

In a hand-held power tool of this type the handle housing may be provided with a collar which receives a complementary neck of the motor housing. The latching arrangement has at least two locking recesses in the motor housing so as to be offset relative to one another by a rotational angle. A locking member may be pivotally connected to the handle and spring-biased to engage in the locking recesses, and manually releasable before turning the handle between operation positions. It will be understood that the security of this latching arrangement is very important for safe tool operation, and one way in which security has been improved has been to use a clamping device, together with the locking member, which clamps the handle to the tool housing in the two operating positions. However, clamping devices are relatively costly to produce so there remains an unmet need to improve the security of the handle in power tools of this type, without substantially increasing manufacturing costs. It is an object of the present invention to address this need or more generally to provide an improved hand-held power tool.

DISCLOSURE OF THE INVENTION

According to one aspect of the present invention there is provided a hand-held power tool, comprising:

a housing holding a motor;

a tool head arranged at one end of the motor housing and having a projecting drive spindle for a tool;

a handle attached to another end of the motor housing and having a trigger moveable from an extended position in which the motor is switched off and a retracted position in which the motor is switched on, the handle being rotatable relative to the motor housing around a longitudinal axis of the motor housing;

a manually actuated latch for fixing the handle in at least two different rotational positions, and an interlock mechanism having a locking and an unlocking position, the interlock mechanism cooperating with the trigger such that with the trigger in the extended position the interlock mechanism is in the unlocking position and with the trigger in the retracted position the interlock mechanism is in the locking position for fixing the handle in the at least two different rotational positions.

Preferably the motor housing includes first, second, third and fourth recesses and the interlock mechanism includes an interlock lever pivoted by movement of the trigger from the extended to the retracted position, and wherein at the two different rotational positions the latch is engaged with one of the first and second recesses, while the interlock lever is engaged with one of the third and fourth recesses. Alternatively, it will be understood that the interlock mechanism may act to prevent movement of the latch from freeing the handle to rotate whenever the trigger is pressed.

It will be understood that the interlock mechanism may include a number of types of known components or assemblies, for instance, the interlock mechanism may include an interlock slider which reciprocates along a predefined path between the locking and unlocking positions, instead of a pivoting lever. In place of a single member, multiple cooperating elements may be employed.

Preferably the trigger is elongated in the direction of a longitudinal axis of the handle, the handle is provided with one of a collar and a complementary neck received therein, the motor housing having the other of the collar and complementary neck, one end of the trigger is coupled to the handle by a pivot proximate an outer end of the handle, and the other end of the trigger is disposed near the collar, the outer end of the trigger abutting the interlock lever in the locking position.

Preferably when the handle is not at one of the two different rotational positions the locking lever is held in its unlocking position and acts upon the trigger, preventing the trigger moving to its retracted position to switch on the motor.

Preferably interlock lever includes a boss through which a fulcrum shaft passes to mount the interlock lever to the handle, and the interlock lever includes first and second arms inclined obliquely to one another, the first arm abutting the trigger and the second arm engaging the third and fourth recesses.

Preferably the interlock mechanism further includes a torsion spring for urging the interlock lever to rotate towards its unlocking position, the torsion spring having a helical portion disposed generally coaxially with the fulcrum shaft.

This invention provides a hand-held power tool device with a locking rotatable handle which is effective and efficient in operational use, and which may be economically constructed due to its overall simple design. The interlock mechanism provides greater security for the rotating connection between the handle and the motor housing, preventing any accidental actuation of the latch from freeing the handle to rotate whenever the trigger is pressed and the tool is in use.

BRIEF DESCRIPTION OF THE DRAWINGS

Preferred forms of the present invention will now be described by way of example with reference to the accompanying drawings, wherein.

DESCRIPTION OF THE PREFERRED EMBODIMENTS

Figure 1:
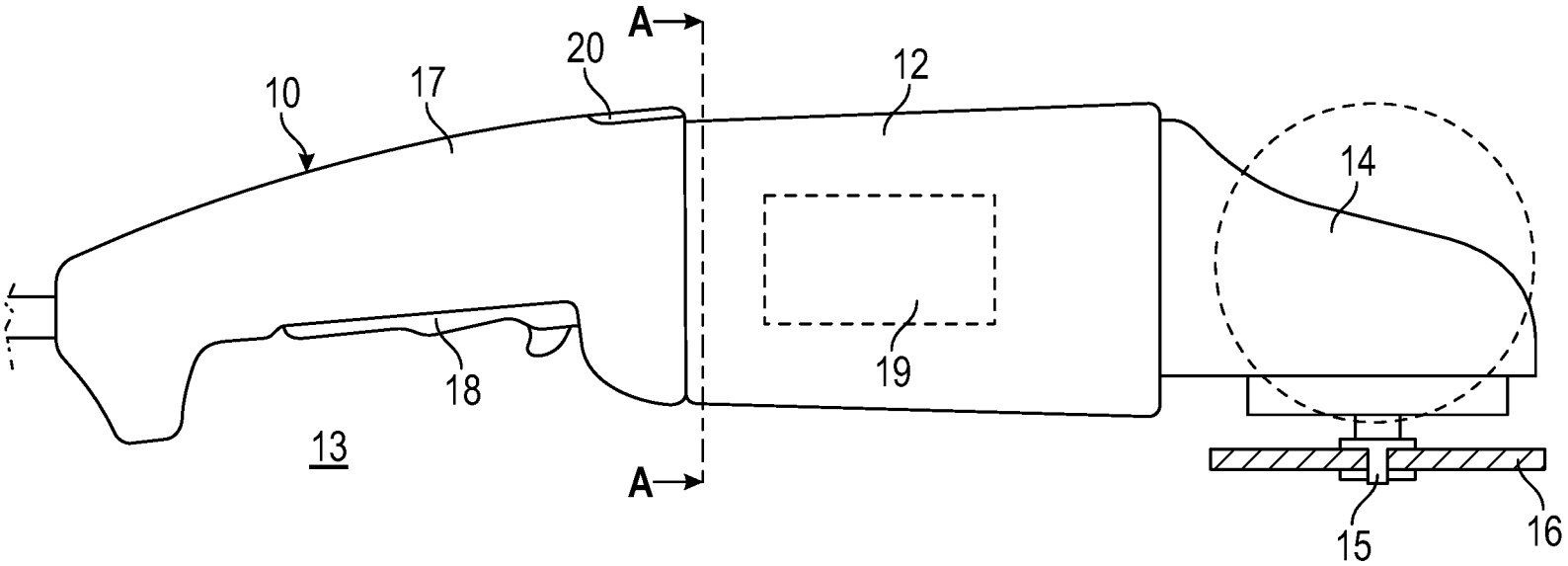
FIG. 1 is a side view of a hand-held electric angle grinder according to the invention.

In one preferred embodiment an electric hand-held power tool according to the invention is provided in the form of an angle grinder as shown in FIG. 1, which generally includes a motor housing 12, a tool head 14 which is arranged at one end of the motor housing 12 and has a projecting drive spindle 15 for a grinding disc 16, and a handle 10 which is arranged at the other end of the motor housing 12 and is constructed so as to be rotatable relative to the motor housing 12 around the longitudinal axis of the latter over a predetermined angle. The handle 10 includes a grip 17 which is grasped by the hand when working with the angle grinder and a trigger 18 which actuates an on/off switch for an electric drive motor 19 accommodated in the motor housing 12. The tool head 14 is fixed with the motor housing 12, while the handle 10 which is rotatable relative to the motor housing 12 and can be fixed in two different angular positions by a latch 20 mounted to the handle 10. In the first position of the motor housing 12 and handle 10 shown in FIG. 1 the angle grinder is used for grinding or sanding. In this relative position, the grinding disc 16 is roughly parallel to the work surface. By rotating the motor housing 12 by 90 degrees relative to the handle 10, the angle grinder can be moved out of this first position into a second position for cutting work. In this second position of the angle grinder the handle 10 is maintained in the position shown in FIG. 1 and the motor housing 12, including the tool head 14, is rotated by 90.degree. so that the grinding disc 16 assumes the position shown in dashed lines in FIG. 1 in which it is aligned approximately at a right angle to the work surface.

Figure 2:
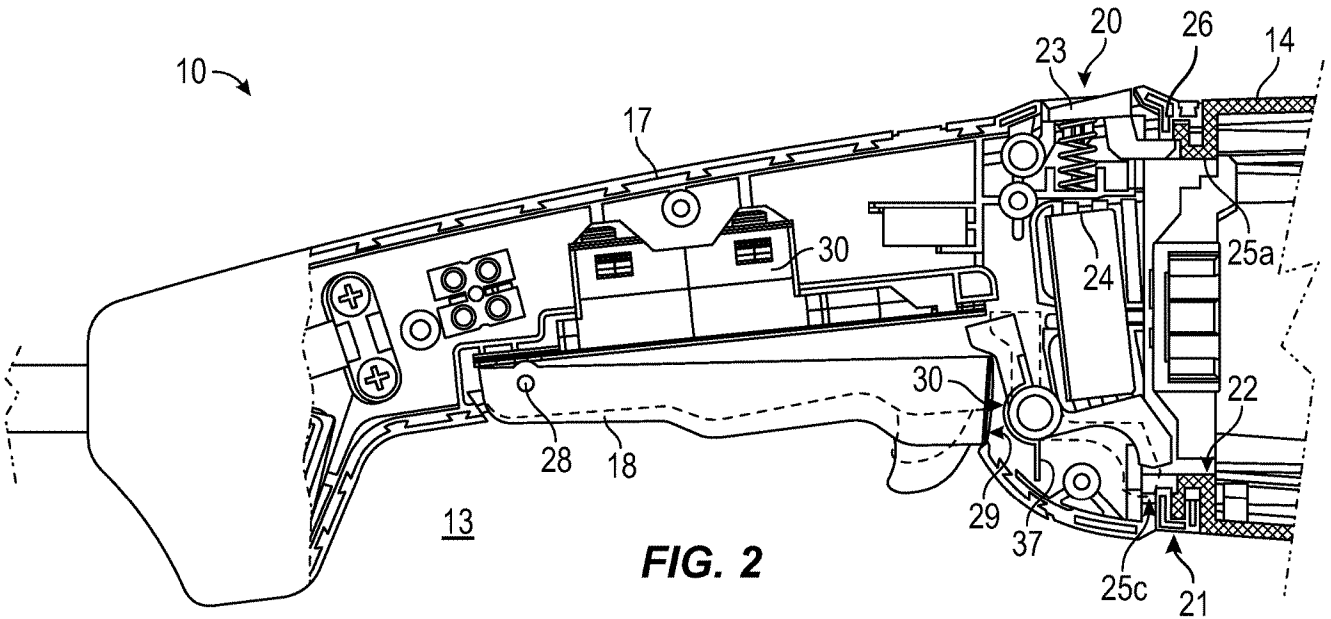
FIG. 2 is an enlarged view of the handle with parts of the motor housing of the angle grinder of FIG. 1, partially in section.
Figure 3:
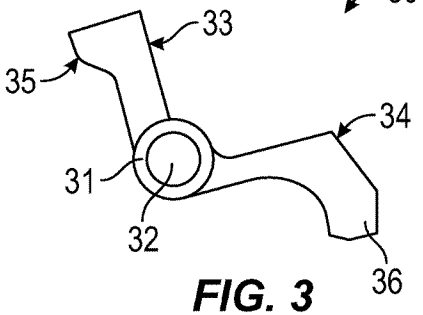
FIG. 3 shows a side view of the interlock lever of FIG. 2.
Figure 4:
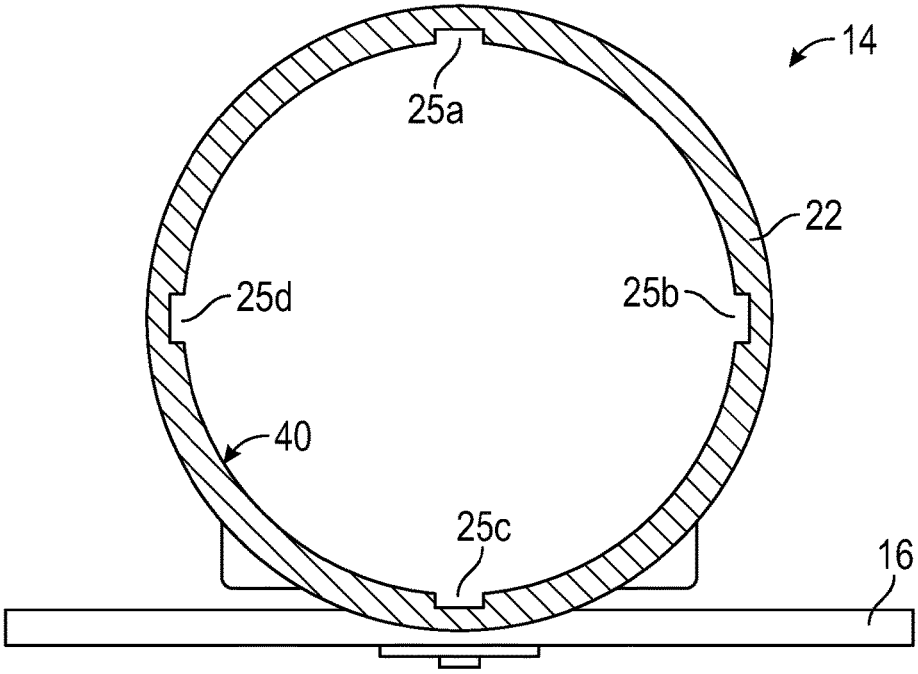
FIG. 4 shows a section along line AA in FIG. 1.

Referring to FIGS. 2 to 4, the handle 10 may be formed from two elongate moulded polymeric shells (one of which is shown removed in FIG. 1), while FIG. 1 shows the motor housing 12 in longitudinal section. To provide the rotary joint between the engaging ends of the handle 10 and motor housing 12, a collar 21 on the handle 10 receives a complementary neck 22 on the motor housing 12, the collar 21 and neck 22 may have slidingly engaged circumferential rib and groove pairs which cooperate to provide a rotary bearing.

The latch 20 and an interlock mechanism 22 may be mounted on generally opposing sides of the handle 10, near diametrically opposing sides of the collar 21. The latch 20 includes a latching member 23 pivotally mounted to the handle 10 and urged outwardly from the handle 10 by a spring 24. A finger 26 formed on one end of the latching member 23 projects into the neck 22 of the motor housing 12 and has a shape complementary to first and second recesses 25*a*, 25*b* formed in the neck 22 90 degrees apart. The latch 20 may be manually be depressed from the latched position shown in FIG. 2 to disengage the finger 26 from the recess 25*a* and it serves to fix the handle 10 in two different rotational positions defined by the recesses 25*a*, 25*b*.

The trigger 18 is recessed within a concavity 13 formed in the handle 10 and is of a known type, being elongated in the direction of a longitudinal axis of the handle 10. One end of the trigger 18 is coupled to the handle 10 by a transverse pivot 28 proximate an outer end of the handle 10, and the other end of the trigger 18 is disposed near the collar 21, the trigger 18 having an outer end 29 opposite the pivot 28. The trigger 18 pivots between the extended position shown in which the motor 19 is switched off and a retracted position (shown in dashed outline in FIG. 2) in which the trigger 18 actuates a switch 30 to switch in the motor 19 when the tool is in use.

The interlock mechanism 22 includes an interlock lever 30 with a boss 31 through which a transverse fulcrum shaft 32 passes to mount the interlock lever 30 to the handle 10. First and second arms 33, 34 are inclined obliquely to one another such that the interlock lever 30 is generally "L" shaped. The first arm 33 has a face 35 abutting the outer end 29 of the trigger 18 and the second arm 34 has a tip 36 that projects into the mouth 22 and is complementary to the third and fourth recesses 25*c*, 25*d*. A torsion spring 37 has a helical portion disposed generally coaxially with the fulcrum shaft 32 and urges the interlock lever 30 to rotate towards its unlocking position shown in FIG. 2, urging the face 35 against the outer end 29 of the trigger. When the trigger 18 is squeezed and pivoted toward its retracted position this engagement with the interlock lever 30 rotates the interlock lever to its locking position (shown in dashed outline in FIG. 2), in which the tip 36 is inserted into the recess 25*c*.

In use, the latch 20 is pressed to permit rotation of the handle 10 relative to the motor housing 12 without the need to operate any other device for connecting the handle and motor housing 12. This permits the handle 10 to be very readily rotated as the use dictates. When the trigger 18 is pressed the interlock mechanism 22 provides a back up to the latch 20, and maintaining the fixed relation between the handle 10 and motor housing 12 in case the latch 20 is mistakenly operated when the tool is being operated.

In addition, with the tool not in use and the handle 10 is not in one of its operating positions, the interlock lever 30 is misaligned with either of the recesses 25*c*, 25*d*. A small movement of the trigger 18 serves to press the tip 36 of the interlock lever 30 against the concave surface 40 that spans between the third and fourth recesses 25*c*, 25*d*. In this position the switch 30 is not yet actuated to start the motor and the trigger 18 is blocked by the unlock lever 30 and is unable to pivot to its locking position, in which case the interlock lever 30 prevents the trigger 18 being depressed, except in the operating positions defined by the recesses 25*a*-25*d*. This prevents the tool being started up in an unsafe condition, in which the handle 10 is free to rotate.

Aspects of the present invention have been described by way of example only and it should be appreciated that modifications and additions may be made thereto without departing from the scope thereof.

The invention claimed is:

1. A hand-held power tool, comprising:

a housing holding a motor;

a tool head arranged at one end of the motor housing and having a projecting drive spindle for a tool;

a handle attached to another end of the motor housing and having a trigger moveable from an extended position in which the motor is switched off and a retracted position in which the motor is switched on, the handle being rotatable relative to the motor housing around a longitudinal axis of the motor housing;

a manually actuated latch configured to fix the handle in at least two different rotational positions, and an interlock mechanism having a locking and an unlocking position, the interlock mechanism configured to cooperate with the trigger such that with the trigger in the extended position the interlock mechanism is biased by a spring towards the unlocking position and with the trigger in the retracted position the interlock mechanism is in the locking position against the bias of the spring for fixing the handle in the at least two different rotational positions.

2. The tool of claim 1 wherein the motor housing includes first, second, third and fourth recesses and the interlock mechanism includes an interlock lever pivotable by movement of the trigger from the extended to the retracted position, and wherein at the two different rotational positions the latch is engaged with one of the first and second recesses, while the interlock lever is engaged with one of the third and fourth recesses.

3. The tool of claim 2 wherein the trigger is elongated in the direction of a longitudinal axis of the handle, the handle is provided with one of a collar and a complementary neck received therein, the motor housing having the other of the collar and complementary neck, one end of the trigger is coupled to the handle by a pivot proximate an outer end of the handle, and an other end of the trigger is disposed near the collar, the outer end of the trigger abutting the interlock lever in the locking position.

4. The tool of claim 1 wherein when the handle is not at one of the at least two different rotational positions the interlock mechanism is biased by the spring toward its unlocking position and acts upon the trigger, inhibiting the trigger from moving to its retracted position to switch on the motor.

5. The tool of claim 4 wherein the spring is a torsion spring configured to urge the interlock mechanism to rotate towards its unlocking position, the torsion spring having a helical portion disposed generally coaxially with the fulcrum shaft.

6. The tool of claim 1 wherein the interlock mechanism includes a boss through which a fulcrum shaft passes to mount the interlock mechanism to the handle, and the interlock mechanism includes first and second arms inclined obliquely to one another, the first arm abutting the trigger and the second arm engaging the third and fourth recesses.

7. The tool of claim 1, wherein the latch selectively fixes the handle in one of the at least two different rotational positions, and wherein with the trigger in the retracted position the interlock mechanism is in the locking position selectively fixing the handle in the one of the at least two different rotational positions.

8. The tool of claim 1, wherein the interlock mechanism and the trigger are operatively coupled such that the interlock mechanism is actuated towards the locking position by movement of the trigger.

9. The tool of claim 1, wherein the motor housing further comprises a plurality of recesses, wherein the interlock mechanism is configured to be selectively disposed in one of the plurality of recesses to lock the handle, wherein the latch is configured to be selectively disposed in another one of the plurality of recesses to lock the handle, and wherein the interlock mechanism and the latch are configured to not be disposed in the same one of the plurality of recesses at the same time.

10. The tool of claim 9, wherein the spring is a first spring and is configured to bias the interlock mechanism away from the one of the plurality of recesses, further comprising a second spring configured to bias the latch towards the another one of the plurality of recesses for fixing the handle.

11. The tool of claim 1, wherein the motor housing further comprises a plurality of recesses spaced from each other in a circular path around the longitudinal axis, wherein the latch is configured to be disposed in one of the plurality of recesses and the interlock mechanism is configured to be disposed in another one of the plurality of recesses to simultaneously fix the handle in one of the rotational positions.

12. The tool of claim 11, wherein the one of the plurality of recesses is disposed 180 degrees apart from the another one of the plurality of recesses.

13. A hand-held power tool, comprising:

a housing holding a motor;

a tool head arranged at one end of the motor housing and having a projecting drive spindle for a tool;

a handle attached to another end of the motor housing and having a trigger configured to be moveable from an extended position in which the motor is switched off and a retracted position in which the motor is switched on, the handle configured to be rotatable relative to the motor housing around a longitudinal axis of the motor housing;

a manually actuated latch configured to engage the motor housing to fix the handle in at least two different rotational positions, and an interlock mechanism having a locking and an unlocking position, the interlock mechanism configured to cooperate with the trigger such that with the trigger in the extended position the interlock mechanism is in the unlocking position and with the trigger in the retracted position the interlock mechanism is in the locking position for fixing the handle in the at least two different rotational positions;

wherein the interlock mechanism is biased toward the unlocking position by a spring.

14. The tool of claim 13, wherein the spring is a first spring, wherein the latch is biased by a second spring to fix the handle in one of the at least two different rotational positions.

15. The tool of claim 13, wherein the interlock mechanism is configured to engage the motor housing, separately from the manually actuated latch, to fix the handle in the at least two different rotational positions.

16. The tool of claim 13, wherein the motor housing further comprises a plurality of recesses, wherein the interlock mechanism is configured to be selectively disposed in one of the plurality of recesses to lock the handle, wherein the latch is configured to be selectively disposed in another one of the plurality of recesses to lock the handle.

17. A hand-held power tool, comprising:

a housing holding a motor;

a tool head arranged at one end of the motor housing and having a projecting drive spindle for a tool;

a handle attached to another end of the motor housing and having a trigger moveable from an extended position in which the motor is switched off and a retracted position in which the motor is switched on, the handle being rotatable relative to the motor housing around a longitudinal axis of the motor housing;

a manually actuated latch configured to engage the motor housing to fix the handle in at least two different rotational positions, and an interlock mechanism operatively coupled for movement with the trigger and having a locking and an unlocking position, the interlock mechanism configured to cooperate with the trigger such that with the trigger in the extended position the interlock mechanism is in the unlocking position and with the trigger in the retracted position the interlock mechanism is in the locking position for fixing the handle in the at least two different rotational positions;

wherein the interlock mechanism is biased into engagement with the trigger by a spring configured to exert a spring force towards the trigger.

18. The tool of claim 17, wherein the spring is a first spring, wherein the latch is biased by a second spring to fix the handle in one of the at least two different rotational positions.

19. The tool of claim 17, wherein the interlock mechanism is configured to engage the motor housing, separately from the manually actuated latch, to fix the handle in the at least two different rotational positions.

20. The tool of claim 17, wherein the motor housing further comprises a plurality of recesses, wherein the interlock mechanism is configured to be selectively disposed in any one of the plurality of recesses to lock the handle, wherein the latch is configured to be selectively disposed in any one of the plurality of recesses to lock the handle.

* * * * *